US008109500B2

(12) United States Patent
Shin et al.

(10) Patent No.: US 8,109,500 B2
(45) Date of Patent: Feb. 7, 2012

(54) MEDIUM SUPPLY UNIT AND IMAGE FORMING APPARATUS HAVING THE SAME

(75) Inventors: Dong-hyup Shin, Seongnam-si (KR); Hyun-soo Kim, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/785,899

(22) Filed: May 24, 2010

(65) Prior Publication Data

US 2011/0121509 A1 May 26, 2011

(30) Foreign Application Priority Data

Nov. 25, 2009 (KR) ..... 10-2009-0114345

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | | |
|---|---|---|---|---|
| 4,900,003 | A * | 2/1990 | Hashimoto | 271/114 |
| 4,934,686 | A * | 6/1990 | Ono et al. | 271/117 |
| 5,265,859 | A * | 11/1993 | Watson et al. | 271/109 |
| 6,554,270 | B2 * | 4/2003 | Yamamoto | 271/117 |
| 7,059,596 | B2 * | 6/2006 | Iwase | 271/114 |
| 7,264,240 | B1 * | 9/2007 | Lee | 271/273 |
| 7,445,206 | B2 * | 11/2008 | Lee | 271/117 |
| 7,571,905 | B2 * | 8/2009 | Kim | 271/117 |
| 7,694,954 | B2 * | 4/2010 | Lee | 271/117 |
| 7,717,415 | B2 * | 5/2010 | Kim et al. | 271/110 |
| 7,802,784 | B2 * | 9/2010 | Yamamoto | 271/117 |
| 2008/0101842 | A1 | 5/2008 | Takahashi | |

FOREIGN PATENT DOCUMENTS

| | | |
|---|---|---|
| JP | 2000-327147 | 11/2000 |
| JP | 2008105813 | 5/2008 |

* cited by examiner

*Primary Examiner* — David H Bollinger
(74) *Attorney, Agent, or Firm* — Stanzione & Kim, LLP

(57) ABSTRACT

A medium supply unit of an image forming apparatus, the medium supply unit may include: a main body housing; a tray connected to the main body housing and loading a printing-target medium therein; an activating shaft connected to the main body housing and being rotated in a predetermined direction by an activating force of an activating source; an intermediate member supported by one end of the activating shaft to deliver a rotating force of the activating shaft; a first elastic member having one end connected to the intermediate member and the other end supported by the activating shaft; and elastically biasing the intermediate member in a direction facing the printing-target medium according to a rotation of the activating shaft; and a roller unit having a roller unit housing that is attachable to the intermediate member and at least one roller that is supported by the roller unit housing and picks up and supplies printing-target media loaded in the tray; and configured to deliver to the roller(s) an elastic force of the first elastic member and a rotating force of the activating shaft when the activating shaft is rotated.

17 Claims, 8 Drawing Sheets

MEDIUM SUPPLY UNIT AND IMAGE FORMING APPARATUS HAVING THE SAME

CROSS-REFERENCE TO RELATED APPLICATIONS

This application claims priority from Korean Patent Application No. 10-2009-0114345, filed on Nov. 25, 2009 in the Korean Intellectual Property Office, the disclosure of which is incorporated herein in its entirety by reference.

BACKGROUND

1. Field of the Invention

Apparatuses and methods consistent with the exemplary embodiments relate to a medium supply unit to supply a printing-target medium to an image forming unit of forming an image; and an image forming apparatus having the same, and more particularly, to a medium supply unit in which the assembly structure of a pickup roller assembly to pick up and supply loaded printing-target media is improved and; and an image forming apparatus having the same.

2. Description of the Related Art

An image forming apparatus can form a visual image by a developing solution or an ink on a printing-target medium based on image data supplied from an external host apparatus. To that end, the image forming apparatus includes an image forming unit and a medium supply unit which supplies a printing-target medium to the image forming unit.

In the medium supply unit of the image forming apparatus, a plurality of printing-target media are loaded in a loading cassette that is attachable to a housing of a main body thereof or in a loading tray that is pivotable with respect to the housing. The loaded printing-target media are picked up by a pickup roller to be supplied to the image forming unit.

Such a pickup roller is made of a material having a high frictional coefficient, such as a synthetic rubber, and rotatable while being brought into contact with the printing-target media with a predetermined pressure to pick up the printing-target media by a frictional force therebetween. Accordingly, if the pickup roller is used for a long period of time, a surface of the pickup roller is worn out by such friction, thereby lowering the picking-up performance thereof. Therefore, there is a requirement to replace the old pickup roller with a new one in adequate intervals.

In the meantime, the old pickup roller is required to be separated from an activating shaft, used to rotate the pickup roller, to be replaced with a new one. Since, however, the activating shaft penetrates through the pickup roller in such a conventional medium supply unit, the activating shaft and the pickup roller are required to be separated together from a main body of the image forming apparatus in order to replace the pickup roller. In this case, the time that it takes to replace the pickup roller is increased because the assembly structure of the pickup roller in the main body thereof is complex.

SUMMARY

Exemplary embodiments of the present general inventive concept provide a medium supply unit and an image forming apparatus having the same, in which an assembly structure of a pickup roller to pick up loaded printing-target media is simply embodied.

Additional features and utilities of the present general inventive concept will be set forth in part in the description which follows and, in part, will be obvious from the description, or may be learned by practice of the general inventive concept.

Embodiments of the present general inventive concept may be achieved by providing a medium supply unit of an image forming apparatus, the medium supply unit including: a main body housing; a tray connected to the main body housing and loading a printing-target medium therein; an activating shaft connected to the main body housing and being rotated in a predetermined direction by an activating force of an activating source; an intermediate member supported by one end of the activating shaft to deliver a rotating force of the activating shaft; a first elastic member having one end connected to the intermediate member and the other end supported by the activating shaft; and elastically biasing the intermediate member in a direction facing the printing-target medium according to a rotation of the activating shaft; and a roller unit having a roller unit housing that is attachable to the intermediate member and at least one roller that is supported by the roller unit housing and picks up and supplies printing-target media loaded in the tray; and configured to deliver to the roller(s) an elastic force of the first elastic member and a rotating force of the activating shaft when the activating shaft is rotated.

The first elastic member may include a torsion spring that is wound around the activating shaft, and when the activating shaft is rotated, a wound diameter of the torsion spring may be reduced, thereby increasing a friction between the torsion spring and the activating shaft.

The reduced diameter of the torsion spring may be recovered to an original state when the activating shaft is stopped to be rotated.

The medium supply unit may include a second elastic member configured to elastically bias the intermediate member in a direction in which the roller unit is separated from the printing-target medium when the activating shaft is stopped to be rotated.

The rollers may include a first roller arranged at a same axis line as that of the activating shaft; and a second roller arranged at an axis line that is separated in parallel from that of the first roller.

The second roller may be pivotable, with respect to the first roller, from a supply position, where the printing-target medium loaded in the tray is supplied, to a separated position, where the second roller is separated from the supply position.

The second roller may be pivoted to the supply position by the first elastic member, when the activating shaft is rotated, and to the separated position by the second elastic member, when the activating shaft is stopped to be rotated.

The activating shaft may include an activating shaft coupling part which is formed at one end thereof extending through a through hole formed in the intermediate member and is coupling-connected with the roller unit to deliver the rotating force of the activating shaft.

The roller unit may include a first clutch unit which is coupling-connected with the activating shaft coupling part and selectively engaged with the first roller according to whether or not the activating shaft is rotated.

The first clutch unit may be engaged with the first roller to deliver the rotating force of the activating shaft, when the activating shaft is rotated, and disengaged therewith to enable the first roller to be idle-rotated, when the activating shaft is stopped to be rotated.

The roller unit may include a second clutch unit which receives the rotating force of the activating shaft from the first clutch unit and is selectively engaged or disengaged with the second roller to selectively deliver the delivered rotating force according to whether or not the first clutch unit is engaged with the first roller.

Embodiments of the present general inventive concept may also be achieved by providing an image forming apparatus including: a medium supply unit configured to supply a printing-target medium; and an image forming unit configured to form an image on the printing-target medium supplied from the medium supply unit, wherein the medium supply unit includes: a main body housing; a tray connected to the main body housing and loading a printing-target medium therein; an activating shaft connected to the main body housing and being rotated in a predetermined direction by an activating force of an activating source; an intermediate member supported by one end of the activating shaft to deliver a rotating force of the activating shaft; a first elastic member having one end connected to the intermediate member and the other end supported by the activating shaft; and elastically biasing the intermediate member in a direction facing the printing-target medium according to a rotation of the activating shaft; and a roller unit having a roller unit housing that is attachable to the intermediate member and at least one roller that is supported by the roller unit housing and picks up and supplies printing-target media loaded in the tray; and configured to deliver to the roller(s) an elastic force of the first elastic member and a rotating force of the activating shaft when the activating shaft is rotated.

Embodiments of the present general inventive concept may be achieved by providing a medium supply unit, including: an activating shaft to supply a rotating force; an intermediate member to receive and transfer the rotating force of the activating shaft when the activating shaft is in contact therewith; and a roller unit in contact with the intermediate member and including at least one roller to engage with and disengage with printing media based on whether the activating shaft is supplying a rotating force.

The intermediate member may include an elastic device connected to the activating shaft and the intermediate member such that when the activating shaft is rotated, the elastic device applies a force to the intermediate member to move the intermediate member toward the printing media such that the roller unit is brought into contact with the printing media.

The elastic device may include: a first elastic member surrounding the activating shaft and connected thereto at one end and connected to the intermediate member an opposite end such that when the activating member is rotated, the first elastic member receives a force to be compressed closer to the activating member; and a second elastic member connected at one end to the intermediate member to bias the intermediate member away from the printing media, wherein when the activating shaft rotates by a certain predetermined amount, the force to compress the first elastic member becomes greater that an elastic force of the second elastic member to elastically bias the intermediate member toward the printing media, and when the activating shaft is stopped from rotating, the first elastic member becomes uncompressed such that the elastic force of the second elastic member overcomes the elastic force of the first elastic member to elastically bias the intermediate member away from the printing media.

The roller unit may include a clutching device to engage the at least one roller to rotate when the activating shaft is rotated, and to disengage the at least one roller such that the at least one roller is idle when the activating shaft is not rotated.

The at least one roller may include a first roller to engage with the clutching device when the activating shaft is rotated and a second roller to engage with the clutching device when the activating shaft is rotated.

The clutching device may include: a first clutching unit to engage with the first roller; a second clutching unit to engage with the second roller; and an intermediate gear to engage the first and second clutching units to rotate together when the activating shaft rotates.

Embodiments of the present general inventive concept may be achieved by providing a medium supply unit, including: an activating shaft to supply a rotating force; a roller unit in contact with the activating shaft and including at least one roller to engage with and disengage with printing media based on whether the activating shaft is supplying a rotating force; and an elastic support system connected between the activating shaft and the roller unit to supply an elastic force to the roller unit to bias the roller unit toward the printing media when the activating shaft supplies a predetermined amount of rotating force.

The roller unit may include a clutching system in contact with an end of the activating shaft to engage the at least one roller to rotate when the activating shaft is rotated such that a frictional force is applied to the printing media when the activating shaft rotates, and to disengage the at least one roller to be idle when the activating shaft is stopped from being rotated.

BRIEF DESCRIPTION OF THE DRAWINGS

The above and/or other features and utilities of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
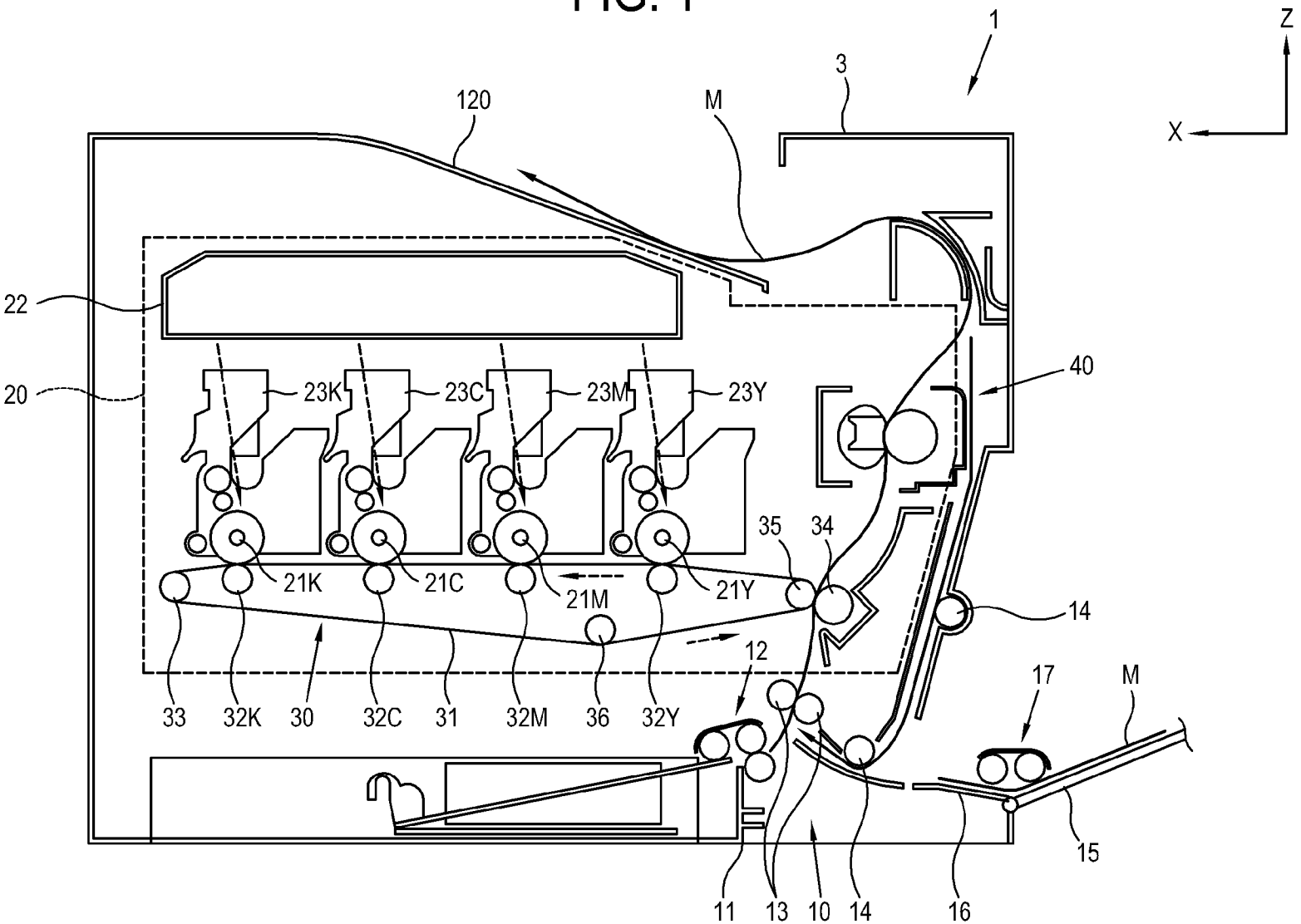
FIG. 1 is a side cross sectional view showing an image forming apparatus in accordance with an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout. Throughout the description of the present embodiments, only elements directly relative to the sprit and scope of the exemplary embodiments are described, while the description of other elements may be omitted. This, however, does not mean that the omitted elements are not essential to embody an image forming apparatus of the exemplary embodiments.

FIG. 1 is a side cross sectional view showing an image forming apparatus 1 in accordance with an exemplary embodiment. The image forming apparatus 1 of the present embodiment may transfer a visual image by a developing solution on a printing-target medium by using an intermediate transfer method. However, the sprit and scope of the present embodiment is not limited thereto. Alternatively, the sprit and scope of the exemplary embodiment is applicable to the image forming apparatus 1 by using various methods regardless of whether a color image or a white-and-black image is formed, transfer method, whether an image is formed by a developing solution or an ink, and the like.

As shown in FIG. 1, the image forming apparatus 1 of the present embodiment may include a main body housing 3 which constitutes an outer appearance thereof; a medium supply unit 10 which loads a printing-target medium therein and supplies the loaded printing-target medium 10; and an image forming unit 20 which forms an image on the printing-target medium supplied from the medium supply unit 10.

The medium supply unit 10 may include a loading cassette 11 which is attachable to the main body housing 3; a first pickup roller assembly 12 which picks up a printing-target medium M from the loading cassette 11; a registration roller 13 which supplies the picked printing-target medium M to the image forming unit 20 with an adequate timing; a duplex roller 14 which inversely sends to the registration roller 13 the printed medium M on which an image has been transferred; a loading tray 15 which is pivotable with respect to the main body housing 3; and a second pickup roller assembly 17 which picks up a printing-target medium M from the loading tray 15.

The loading cassette 11 may be separated from the main body housing 3 to load printing-target media M therein. Then, the loading cassette 11 may be re-connected to the main body housing 3. If a printing process is started, the first pickup roller assembly 12 may pick up a top printing-target medium M of the printing-target media M loaded in the loading cassette 11 and supply it to the registration roller 13.

The registration roller 13 can align a leading end of the sent printing-target medium M and supply the printing-target medium M to the image forming unit 20 with a predetermined timing such that a visual image formed by the image forming unit 20 is transferred on the printing-target medium M.

When there is a request for a duplex printing, the duplex roller 14 can inversely send to the registration roller 13 the printed medium M, one surface of which the image has already been transferred. The printed medium M inversely sent by the duplex roller 14 can be re-supplied to the image forming unit 20 by the registration unit 13 such that another image is transferred on the other surface of the printed medium M on which no image has been transferred.

To perform the printing process, the printing-target medium M may be loaded in the loading tray 15 instead of the loading cassette 11 before being supplied from the medium supply unit 10 to the image forming unit 20.

The loading tray 15 may be connected to the main body housing 3 to be pivotable thereto. The printing-target media M may be loaded in the loading tray 15 when the loading tray 15 is pivoted to be separated from the main body housing 3. The printing-target media M loaded in the loading tray 15 can be picked up by the second pickup roller assembly 17 and guided along a guide frame 16 to be supplied to the registration roller 13. Here, a path through which the printing-target media M picked up by the second pickup roller assembly 17 is supplied may be partially overlapped with a path through which the printed media M are inversely sent by the duplex roller 14.

The image forming unit 20 may include image receptors 21Y, 21M, 21C, and 21K (or collectively referred to as "21") which forms a latent electrostatic image and a visual image on a surface; an exposure unit 22 which exposes the image receptors 21 to form the latent electrostatic image; developing cartridges 23Y, 23M, 23C, and 23K (or collectively referred to as "23") which apply developing solutions to latent electrostatic image of the image receptors 21 to form the visual image; a transfer unit 30 which transfers the visual image of the image receptors 21 on a printing-target medium M according to an intermediate transfer method; and a fixing unit 40 which fixes the image on the printing-target medium M by a heat and a pressure.

The image receptors 21 may be installed for various colors to form a latent electrostatic image on a surface thereof based on image data for various colors by the exposure unit 22. If developing solutions are applied to the image receptors 21, the developing solutions may selectively be attached on the image receptors 21 by an electric potential. As a result, the image receptors 21 may form a visual image by the developing solutions.

The exposure unit 22 may scan a beam of light to the respective image receptors 21Y, 21M, 21C, and 21K, which are uniformly charged, based on the image data for various colors to form a latent electrostatic image. The exposure unit 22 may be embodied as a light scanning unit including a light source (not shown), a polygon lens (not shown), and various optical lenses (not shown).

The developing cartridges 23 may be installed corresponding to the image receptors 21. The developing cartridges 23Y, 23M, 23C, and 23K may contain therein the developing solutions for various colors to apply the contained developing solutions to the respective image receptors 21Y, 21M, 21C, and 21K, respectively. For example, the developing cartridges 23Y, 23M, 23C, and 23K may be installed corresponding to four colors: yellow, magenta, cyan, and black. Moreover, the corresponding developing cartridges 23Y, 23M, 23C, and 23K may be respectively attached to and detached from the main body housing 3 for the replacement.

The transfer unit 30 may include an intermediate transfer belt 31 which is moved in a caterpillar method, the intermediate belt 31 being in contact with the respective image receptors 21Y, 21M, 21C, and 21K; a plurality of intermediate transfer rollers 32Y, 32M, 32C, and 32K (or collectively referred to as "32") which are installed corresponding to the respective image receptors 21Y, 21M, 21C, and 21K, the intermediate transfer belt 31 being placed between the intermediate transfer rollers 32 and the image receptors 21; an activating roller 33 which is rotated to move the intermediate transfer belt 31; a final transfer roller 34 which is provided at a contact portion between the intermediate transfer belt 31 and the path through which the printing-target media M are supplied from the registration roller 13; a transfer backup roller 35 which backs up the intermediate transfer belt 31 with respect to the final transfer roller 34; and a tension roller 36 which applies a tension to the intermediate belt 31.

As shown in FIG. 1, when the activating roller 33 is rotated in a counterclockwise direction, the intermediate transfer rollers 32Y, 32M, 32C, and 32K may successively transfer on the intermediate transfer belt 31 the visual image of the image receptors 21Y, 21M, 21C, and 21K, respectively. At this time, portions of the visual image corresponding to yellow, magenta, cyan, and black can successively be transferred, and the four-color portions of the visual image can be overlapped with each other, thereby forming a final color image.

If the final color image is formed, a printing-target medium M is supplied from the registration roller 13 with an adequate timing. The final transfer roller 34 can transfer the final color image of the intermediate transfer belt 31 on the printing-target medium M.

The fixing unit 40 can perform a fixing operation by applying a heat and a pressure to the printed medium M on which the final color image has been transferred. The printed medium M on which the fixing has been completed may be output external to the image forming apparatus 1.

Figure 2:
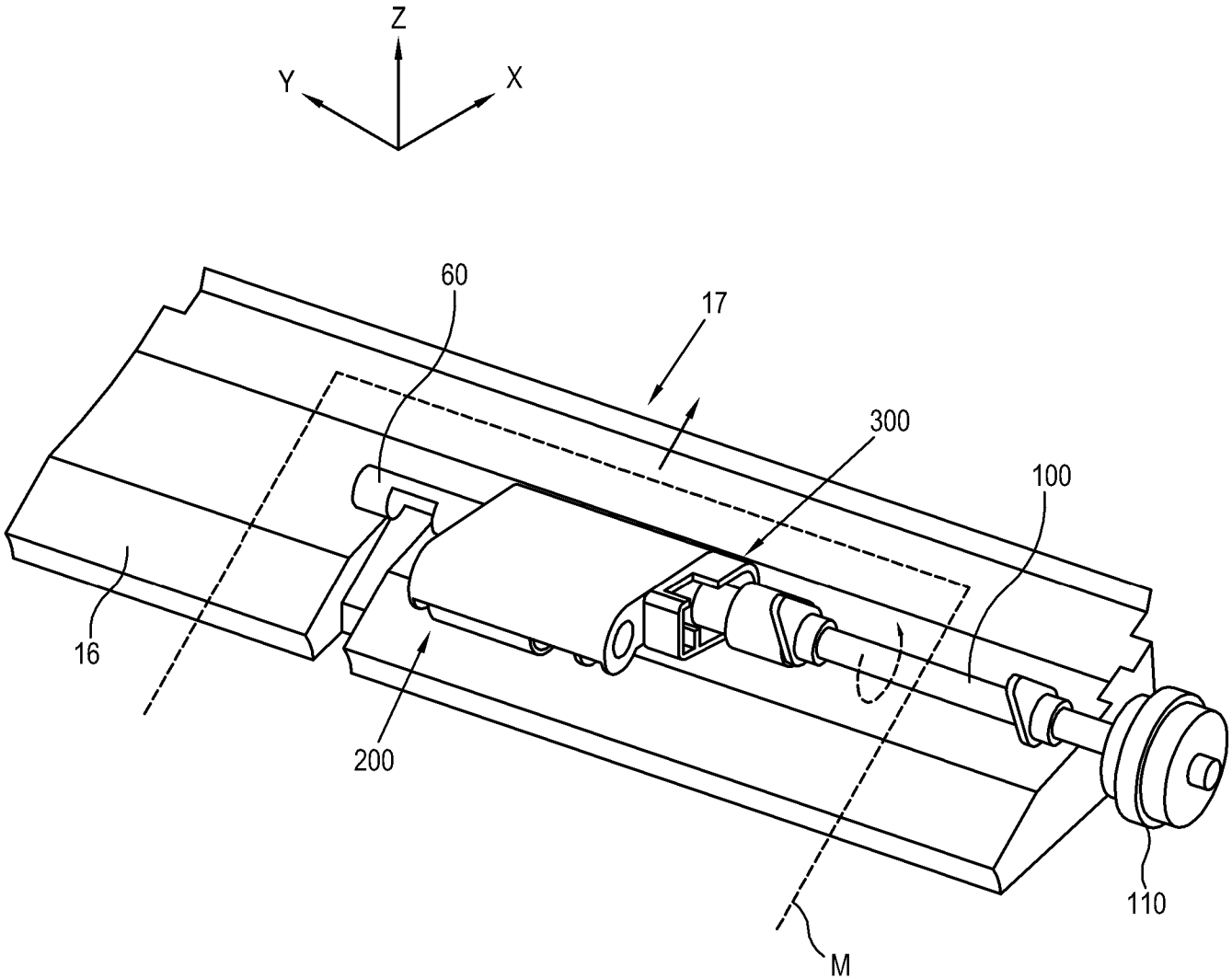
FIG. 2 is a perspective view showing main parts of a second pickup roller assembly in the image forming apparatus shown in FIG. 1.

A configuration of the second pickup roller assembly 17 will be described with reference to FIG. 2, the second pickup roller assembly 17 being configured to pick up a printing-target medium M from the loading tray 15 to supply it to the registration roller 13 in the above-described image forming apparatus 1. FIG. 2 is a perspective view showing main parts of the second pickup roller assembly 17 in the image forming apparatus shown in FIG. 1.

First, each direction shown in FIG. 2 will be described. An X, Y and Z-axis may basically indicate each of the three-dimensional directions. Reverse directions of the X, Y, and Z-axis direction are referred to as −X, −Y, and −Z-axis direction, respectively. In the X-axis direction, the printing-target media M is supplied to the registration roller 13. The Y-axis direction is a direction perpendicular to the X-axis direction. The Z-axis direction is an upper and a lower direction perpendicular to the X-axis direction and the Y-axis direction, respectively. Here, the X-Y plane is a plane formed by the X and the Y-axis.

As shown in FIG. 2, the second pickup roller assembly 17 of the present embodiment may include an activating shaft 100 which is rotatable in a predetermined direction by an activating force of an activating source (not shown); a roller unit 200 which is arranged at one end side of the activating shaft 100 to pick up a printing-target medium M; and an intermediate member 300 which is arranged between the activating shaft 100 and the roller unit 200 to deliver a rotating force of the activating shaft 100 to the roller unit 200.

The activating shaft 100 may extend in the Y-axis direction on the guide frame 16. One of opposite ends of the activating shaft 100 which is located at a central portion of the guide frame 16 may be coupling-connected to the roller unit 200, and the other end thereof which is located at an edge portion of the guide frame 16 may be connected to a clutch 110 which controls the activating force of the activating source (not shown).

When the activating force is permitted to be delivered by the clutch 110, the activating shaft 100 may be rotated in a direction in which the printing-target media M are supplied in the X-axis direction. Since one end of the activating shaft 100 is coupling-connected to the roller unit 200, a rotating force of the activating shaft 100 may be delivered to the roller unit 200. Accordingly, the roller unit 200 may supply the printing-target media M.

Figure 3:
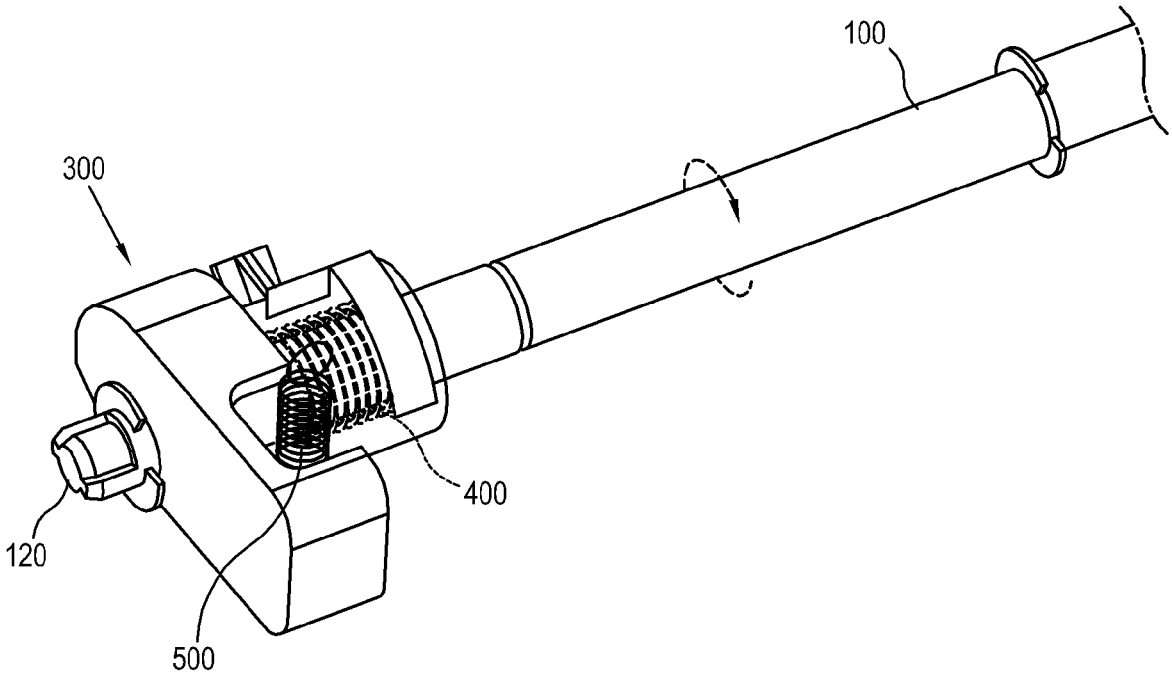
FIG. 3 is a perspective view showing main parts of an activating shaft and an intermediate member in the second pickup roller shown in FIG. 2.

Hereinafter, configurations of the activating shaft 100 and the intermediate member 300 will be described with reference to FIG. 3. FIG. 3 is a perspective view showing main parts of the activating shaft 100 and the intermediate member 300.

As shown in FIG. 3, the activating shaft 100 may extend through the intermediate member 300. The activating shaft 100 may include an activating shaft coupling part 120 which is formed at one end thereof extending through the intermediate member 300 and coupling-connected to the roller unit 200.

One side of the intermediate member 300 where the activating shaft coupling part 120 protrudes may be connected to the roller unit 200. In other words, one side of the roller unit 200 which is coupling-connected to the activating shaft coupling part 120 may be connected to the intermediate member 300. The connecting method of the roller unit 200 and the intermediate member 300 is not limited thereto. Alternatively, easy connection may be made therebetween by applying an engaging structure such as a hook structure, a protrusion and protrusion receiving structure, and a prominence and depression structure.

In the meantime, the second pickup roller assembly 17 may include a first elastic member 400 having one end which is supported by the activating shaft 100 and the other end which is connected to the intermediate member 300; and a second elastic member 500 which is connected to one side of the intermediate member 300.

The first elastic member 400 may be embodied as a torsion spring or an elastic body, one end of which is wound around the activating shaft 100. The other end of the first elastic member 400, which is not wound around the activating shaft 100, may be connected to the intermediate member 300.

The second elastic member 500 may have one end which is connected to the intermediate member 300 and the other end which is connected to a support member (not shown) provided at an upper side of the intermediate member 300. The second elastic member 500 may be embodied as one of various members such as a coil spring and a plate spring.

When a portion of the intermediate member 300 where the activating coupling part 120 extends therethrough corresponds to that of a first roller main body 210 of the roller unit to be described later, a portion of the intermediate member 300 where the second elastic member 500 is connected therewith may correspond to that of a second roller main body 220 of the roller unit. Moreover, a portion of the intermediate member 300 where the first elastic member 400 is connected therewith may be positioned at a side of the second elastic member 500 with reference to the activating shaft 100. Accordingly, the second roller main body 220 may be pivoted with respect to the first roller main body 210. This will be described in more detail later.

The second elastic member 500 may elastically bias the intermediate member 300 in a direction in which the intermediate member 300 is separated from the printing-target media M.

In the above-mentioned configuration, when the activating shaft 100 is rotated, the diameter of the first elastic member 400 that is wound around the activating member 100 may be reduced because the first elastic member 400 is connected to the intermediate member 300. In other words, the first elastic member 400 becomes wound tighter such that the diameter decreases and approaches the activating member 100. Accordingly, the friction between the first elastic member 400 and the activating shaft 100 may be increased, and the intermediate member 300 may be downwardly pivoted with respect to the activating shaft 100. At this time, an elastic force of the second elastic member 500 may be overcome.

When the activating shaft 100 is stopped from rotating, the wound diameter of the first elastic member 400, which is in the reduced state, may be recovered to an original state. Accordingly, the friction between the first elastic member 400 and the activating shaft 100 may be decreased, and the intermediate member 300 may be upwardly pivoted with respect to the activating shaft 100 by the second elastic member 500.

Here, the detailed structure of the first elastic member 400 is as follows.

The first elastic member 400 has two end parts, e.g., a first end part and a second end part. The first end part is fixed to the intermediate member 300. On the other hand, the second end part opposite to the first end part is not fixed to but wound on the outer circumference of the activating shaft 100 while pressing and contacting the outer circumference with predetermined pressure.

With this structure, if the activating shaft 100 rotates, the contact between the second end part of the first elastic member 400 and the outer circumference of the activating shaft 100 may cause the wound diameter of the first elastic member 400 to be decreased depending on a winding direction. When the wound diameter of the first elastic member 400 is decreased, the friction between the first elastic member 400 and the activating shaft 100 increases. Also, the increased friction makes the intermediate member 300 to which the first end part of the first elastic member 400 is fixed be elastically biased.

Then, if the activating shaft 100 stops rotating, the wound diameter of the first elastic member 400 is put back and the friction returns to its original level. Accordingly, the intermediate member 300 is free from the elastic bias.

Figure 4:
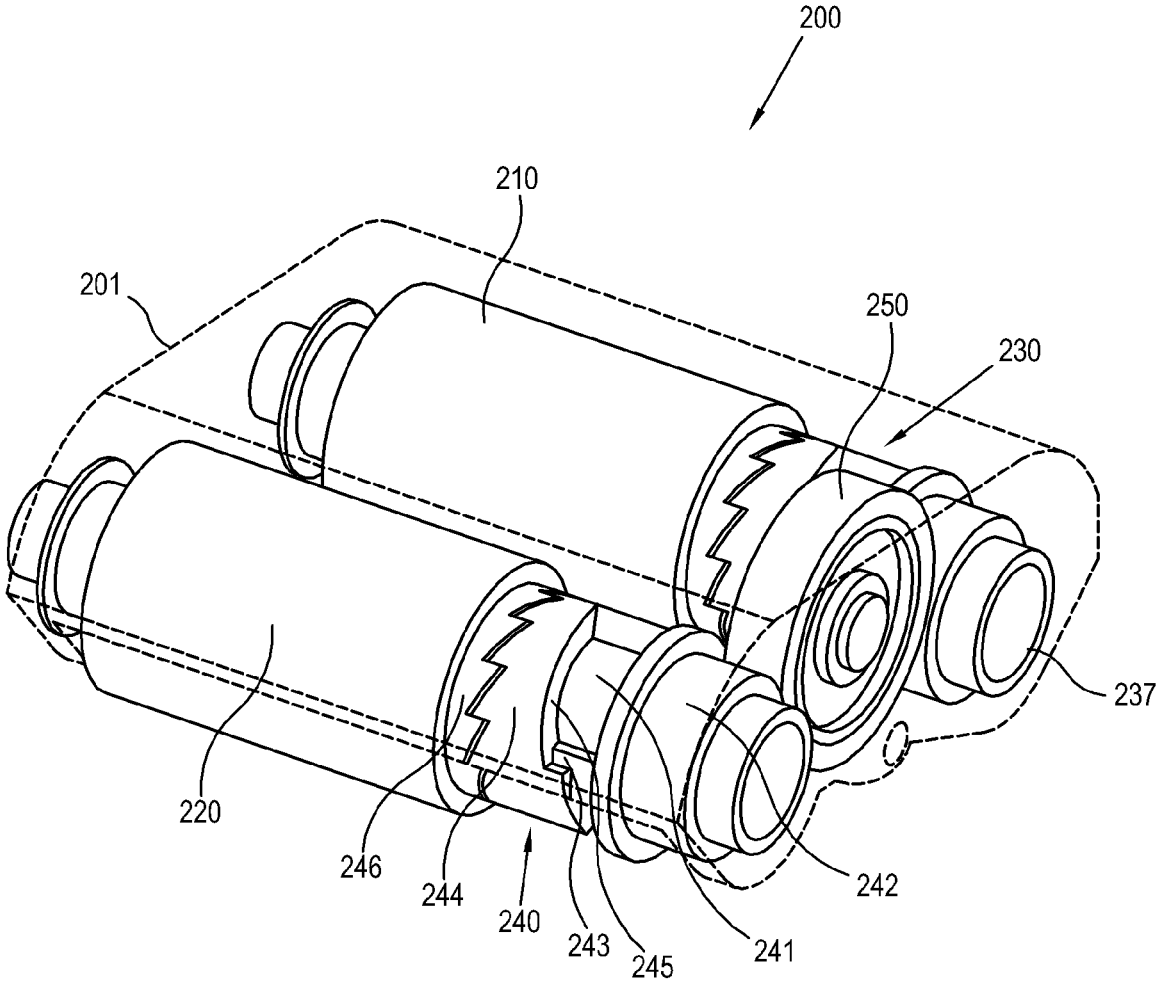
FIG. 4 is a perspective view showing main parts of a roller unit in the second pickup roller assembly.

Hereinafter, a configuration of the roller unit 200 will be described with reference to FIG. 4. FIG. 4 is a perspective view showing main parts of the roller unit 200.

As shown in FIG. 4, the roller unit 200 may include a roller unit housing 201; the first and the second roller main body 210 and 220 which are arranged in parallel with each other in the roller unit housing 201; a first clutch unit 230 which delivers a rotating force of the activating shaft 100 to the first roller main body 210; a second clutch unit 240 which receives the rotating force of the activating shaft 100 from the first clutch unit 230 and delivers this force to the first roller main body 220; and an intermediate gear 250 which is provided between the first and the second clutch unit 230 and 240 to deliver the rotating force from the first clutch unit 230 to the second clutch unit 240.

The roller unit housing 201 may accommodate therein various components of the roller unit 200 and have an open lower surface facing the printing-target media M, the open lower surface through which the first and the second roller main body 210 and 220 can be brought into contact with the printing-target media M. A roller unit coupling part 237 which is to be coupling-connected with the activating shaft coupling part 120 may be formed on one surface of the roller unit housing 201 which is connected to the intermediate member 300.

The first and the second roller main body 210 and 220 may be rotated along with the activating shaft 100 by being connected thereto to pick up and deliver the printing-target media M. The first and the second roller main body 210 and 220 may be made of a material having a relatively high frictional coefficient, such as a synthetic rubber, to pick up the printing-target media M by a frictional force therebetween.

The first roller main body 210 may be arranged in a same axis line as that of the activating shaft 100, and the second roller main body 220 may be arranged and separated from the first roller main body 210 in a direction perpendicular to the axis line.

The first clutch unit 230 may be provided between the activating shaft 100 and the first roller main body 210 in the roller unit housing 102. The roller unit coupling part 237 may be formed at one side of the first clutch unit 230 facing the activating shaft 100 and selectively engaged or disengaged with the first roller main body 210 according to whether or not the activating shaft 100 is rotated.

While the activating shaft 100 is rotated, the first clutch unit 230 may be engaged with the first roller main body 210 to rotate the first roller main body 210. On the other hand, when the activating shaft 100 is stopped from rotating, the first clutch unit 230 may be disengaged from the first roller main body 210 such that the first roller main body 210 is idle-rotated. A configuration of the first clutch unit 230 will be described in detail later.

The second clutch unit 240 may be provided between the intermediate gear 250 and the second roller main body 220 to deliver to the second roller main body 220 the rotating force of the activating shaft 100 supplied through the intermediate gear 250. Similar to the first clutch unit 230, the second clutch unit 240 may be selectively engaged or disengaged with the second roller main body 220 according to whether or not the activating shaft 100 is rotated.

Similarly, while the activating shaft 100 is rotated, the second clutch unit 240 may be engaged with the second roller main body 220 to rotate the second roller main body 220. On the other hand, when the activating shaft 100 is stopped to be rotated, the second clutch unit 240 may be disengaged from the second roller main body 220 such that the second roller main body 220 is idle-rotated.

In other words, while the activating shaft 100 is rotated, the first and the second clutch unit 230 and 240 may enable the first and the second roller main body 210 and 220, respectively, to be rotated in order to pick up and supply the printing-target media M.

On the other hand, when the activating shaft 100 is stopped from rotating, the first and second clutch unit 230 and 240 may enable the first and the second roller main body 210 and 220, respectively, to be idle-rotated. Accordingly, it is possible to reduce the friction between the printing-target media M and the first and the second roller main body 210 and 220, respectively, to thereby supply the printing-target media M easily.

The second clutch unit 240 may include a second clutch main body 241; a second gear 242 which is formed on an outer peripheral surface of the second clutch main body 241 to be engaged with the intermediate gear 250; a second protrusion 243 which protrudes in the second clutch main body 241 between the second gear 242 and the second roller main body 220; a third engaging part 244 which surrounds an outer periphery of the second clutch main body 241 and is installed to be freely rotatable; an inclined part 245 which is formed in the third engaging part 244 along the outer periphery of the second clutch main body 241 and guided by the second protrusion 243; and a fourth engaging part 246 which is connected to the second roller main body 220 to be selectively engaged with the third engaging part 244.

The first clutch unit 230 may have the same configuration as that of the above-mentioned second clutch unit 240. The first and the second clutch unit 230 and 240 will be described in detail later.

Figure 5:
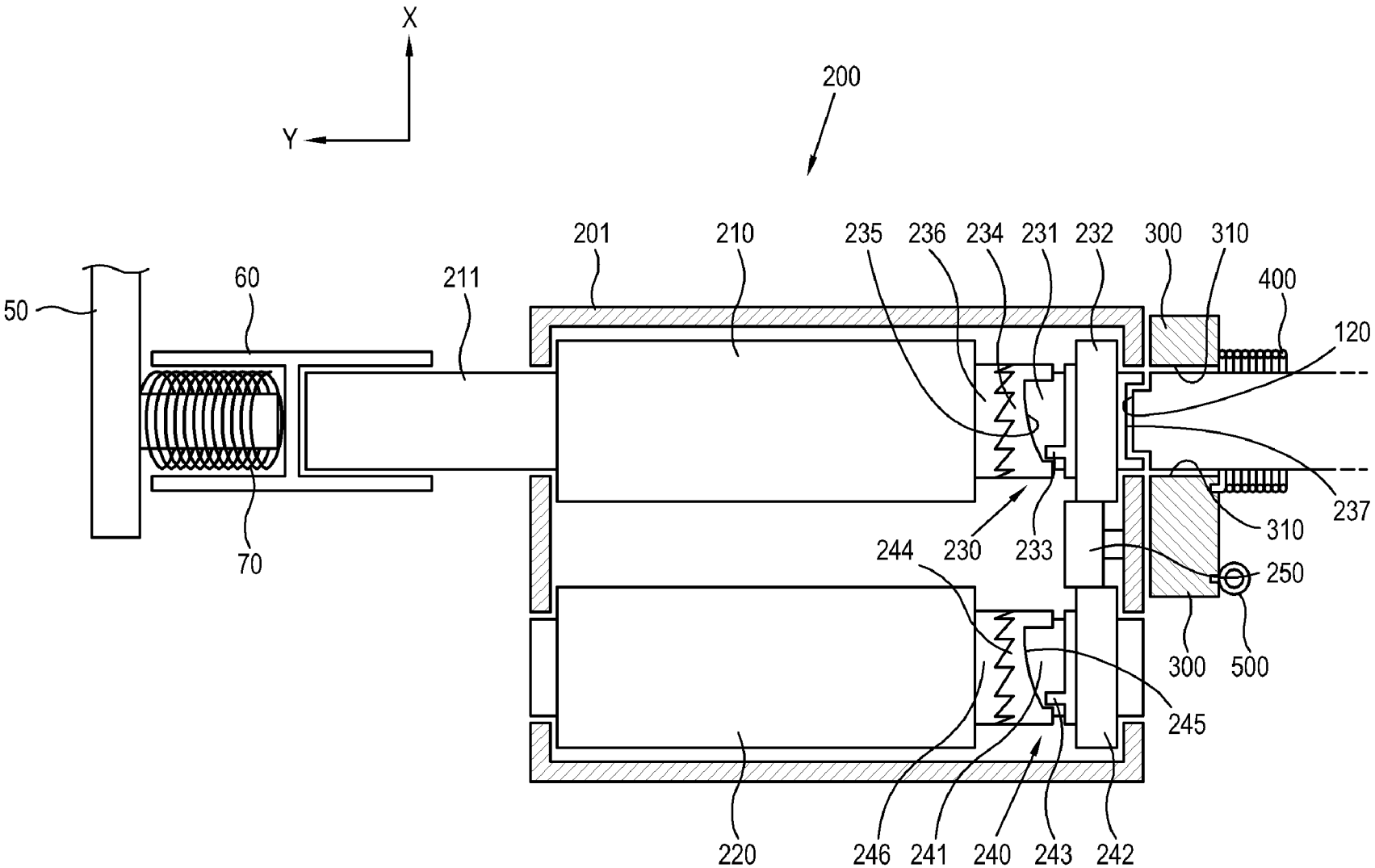
FIG. 5 is a plan view showing the second pickup roller assembly in the image forming apparatus shown in FIG. 1.

Hereinafter, a configuration of the second pickup roller assembly 17 of the present embodiment will be described with reference to FIG. 5. FIG. 5 is a plan view showing the second pickup roller assembly 17.

As shown in FIG. 5, the intermediate member 300 may be connected to a right surface of the roller unit 200, and an activating shaft through hole 310 may be formed at a portion corresponding to the roller unit coupling part 237. The activating shaft 100 may extend through the activating shaft through hole 310. Accordingly, the activating shaft coupling part 120 may be coupling-connected with the roller unit coupling part 237.

The first elastic member 400 may have one end which is wound around the activating shaft 100 and the other end which is connected to the intermediate member 300. One end of the second elastic member 500 may be connected to the intermediate member 300.

The first roller main body 210 may extend along the axis line of the activating shaft 100, and a first roller shaft 211 may extend from the first roller main body 210 in the reverse direction to which the activating shaft 100 is provided. A bushing 60 may be arranged at a left side of the roller unit 200, the bushing 60 being supported by a supporting frame 50 and elastically pressed by a spring 70 in the direction of the activating shaft 100. The first roller shaft 211 may be rotatably supported by the bushing 60.

In the disassembling of the roller unit 200, the activating shaft 100 and the intermediate member 300 may be separated from the roller unit 200 and, then, the first roller shaft 211 may be separated from the bushing 60. Accordingly, it is possible to easily disassemble the roller unit 200. Reversely, in the assembling of the components of the roller unit 200, the first roller shaft 211 may be supported by the bushing 60. Then, the roller unit coupling part 237 may be coupling-connected to the activating shaft coupling part 120, and the intermediate member 300 may be connected to the roller unit 200. Accordingly, it is possible to easily assemble the components of the roller unit 200.

Since each of the first and the second elastic member 400 and 500 is connected to the intermediate member 300 instead of the roller unit 200, it is not necessary to consider the relationship of a connection between the roller unit 200 and each of the first and the second elastic member 400 and 500, especially during a replacement of the roller unit 200. Accordingly, it is possible to easily separate and replace the roller unit 200.

The first clutch unit 230 may include a first clutch main body 231; a first gear 232 which is formed on an outer peripheral surface of the first clutch main body 231 to be engaged with the intermediate gear 250; a first protrusion 233 which protrudes in the first clutch main body 231 between the first gear 232 and the first roller main body 210; a first engaging part 234 which surrounds an outer periphery of the first clutch main body 231 and is installed to be freely rotatable; an inclined part 235 which is formed in the first engaging part 234 along the outer periphery of the first clutch main body 231 and guided by the first protrusion 233; and a second engaging part 236 which is connected to the first roller main body 210 to be selectively engaged with the first engaging part 234. The roller unit coupling part 237 may be formed at a side of the first clutch main body 231 or embodied as an additional member to be connected to the first clutch main body 231.

The first engaging part 234 may have a ring shape of a predetermined width which surrounds the outer periphery of the first clutch main body 231. One side of the first engaging part 234 may have a saw-toothed shape to face the second engaging part 236 such that the first engaging part 234 can engage with the second engaging part 236. The inclined part 235 may be formed in a spiral shape at a predetermined portion along an axis line of the first clutch main body 231 in the reverse direction to the first engaging part 234, i.e., in the direction facing the activating shaft 100. The first protrusion 233 may be hooked onto opposite ends of the inclined part 235 to control the pivoting of the first engaging part 234.

The second engaging part 236 may annularly protrude from an end portion of the first roller main body 210. The second engaging part 236 may accommodate the end portion of the first clutch main body 231 at a central portion thereof and have a shape to engage with the saw-toothed shape of the first engaging part 234.

Once the activating shaft 100 is rotated, the first clutch main body 231 may also be rotated because of the coupling-connection between the activating shaft coupling part 120 and the roller unit coupling part 237. The rotating force of the first clutch main body 231 may be delivered to the second clutch main body 241 through the first gear 232, the intermediate gear 250, and the second gear 242. The second clutch main body 241 may be rotated in the same direction as that of the first clutch main body 231.

As the first and the second clutch main body 231 and 241 are rotated, the first and the third engaging part 234 and 244 may be engaged with the second and the third engaging part 236 and 246, respectively. Accordingly, the rotating forces of the first and the second clutch main body 231 and 241 may be delivered to the first and the second roller main body 210 and 220, respectively.

Therefore, the first and the second roller main body 210 and 220 may be rotated to pick up and supply the printing-target media M.

In the meantime, when the activating shaft 100 is stopped from being rotated, the printing-target media M may be supplied by being brought into contact with each of the first and the second main body 210 and 220. In this case, if the first and the second roller main body 210 and 220 are stopped from being rotated, it may become difficult to supply the printing-target media M due to the friction between the printing-target media M and the first and the second roller main body 210 and 220. Accordingly, the first and the second main body 210 and 220 can be configured to be idle-rotated when the activating shaft 100 is stopped from being rotated.

Hereinafter, a configuration where the first clutch unit 230 is selectively engaged with the first roller unit 210 according to whether or not the activating shaft 100 is rotated will be described with reference to FIGS. 6 and 7. Since the configuration of the first clutch unit 230 is applicable to the second clutch unit 240, the corresponding description will be omitted.

Figure 6:
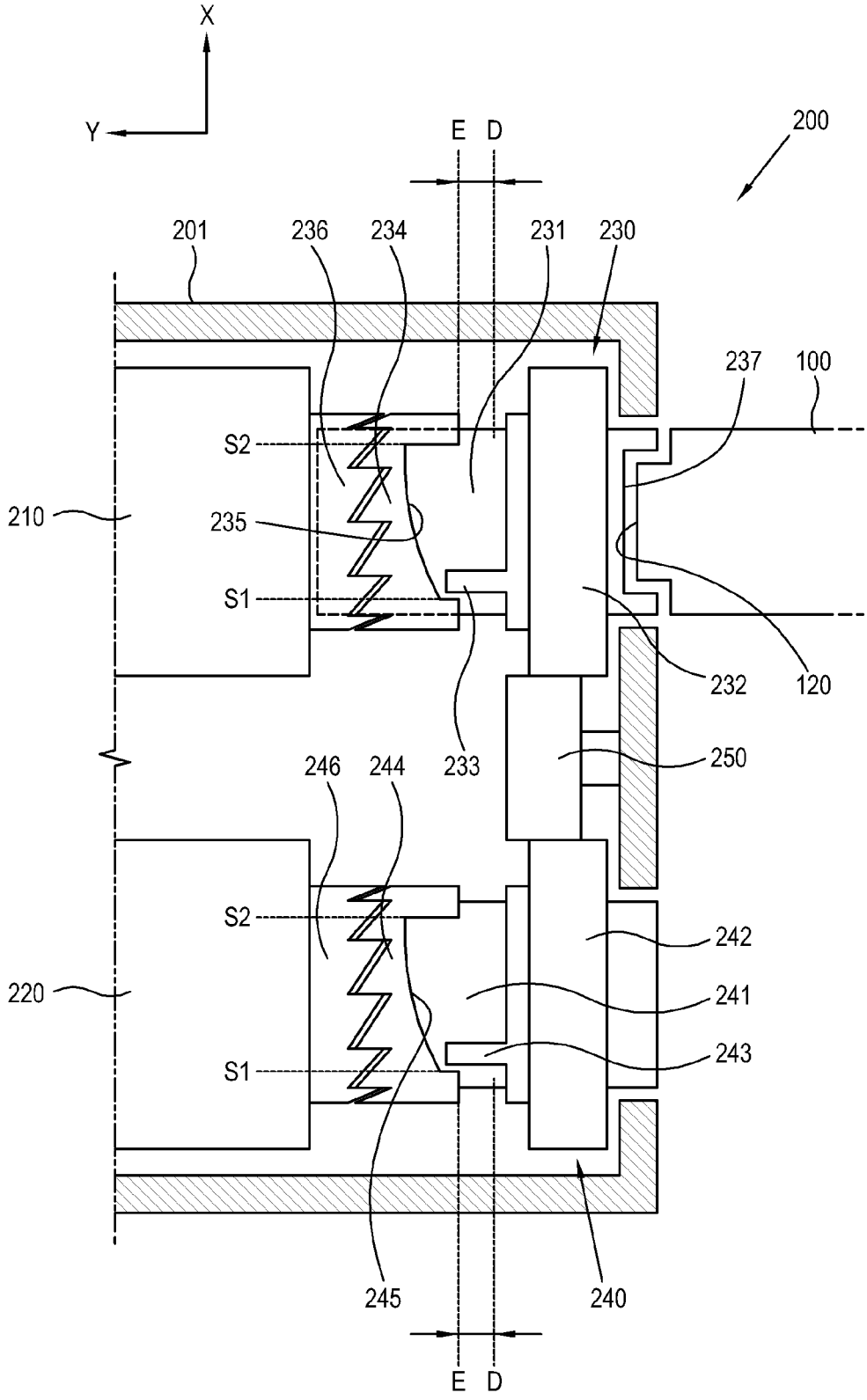
FIG. 6 is a plan view showing how a first and a second clutch unit are engaged with a first and a second roller main body, respectively, in the second pickup roller assembly shown in FIG. 5.

FIG. 6 is a plan view showing how the first and the second clutch unit 230 and 240 are engaged with the first and the second roller main body 210 and 220, respectively, while the activating shaft 100 is rotated.

As shown in FIG. 6, the inclined part 235 may be formed on the first engaging part 234 in the direction facing the first protrusion 233. The inclined part 235 may have opposite ends, i.e., one (first) end S1 and the (second) other end S2 which are controlled by the first protrusion 233. The inclined part 235 may be inclined extending from the second end S2 toward the first end S1 in the direction of the activating shaft 100, i.e., the −Y-axis direction.

The first protrusion 233 may be provided between the first end S1 and the second end S2 and brought into contact with the first end S1 or the second end S2 according to the rotation of the first clutch main body 231.

When the activating shaft 100 is rotated, the first clutch main body 231 may also be rotated by interlocking therewith. Here, the activating shaft 100 may be rotated in a predetermined direction to supply the printing-target media M.

As the first clutch main body 231 is rotated, the first protrusion 233 may press the first end S1 by moving thereto.

Accordingly, the first engaging part 234 may be moved to an engaged position E to be engaged with the second engaging part 236.

While the activating shaft 100 is rotated, the first protrusion 233 may continuously press the first end S1 and, thus, the state where the first engaging part 234 is engaged with the second engaging part 236 may be maintained. Accordingly, the first roller main body 210 may be rotated by interlocking with the activating shaft 100.

Figure 7:
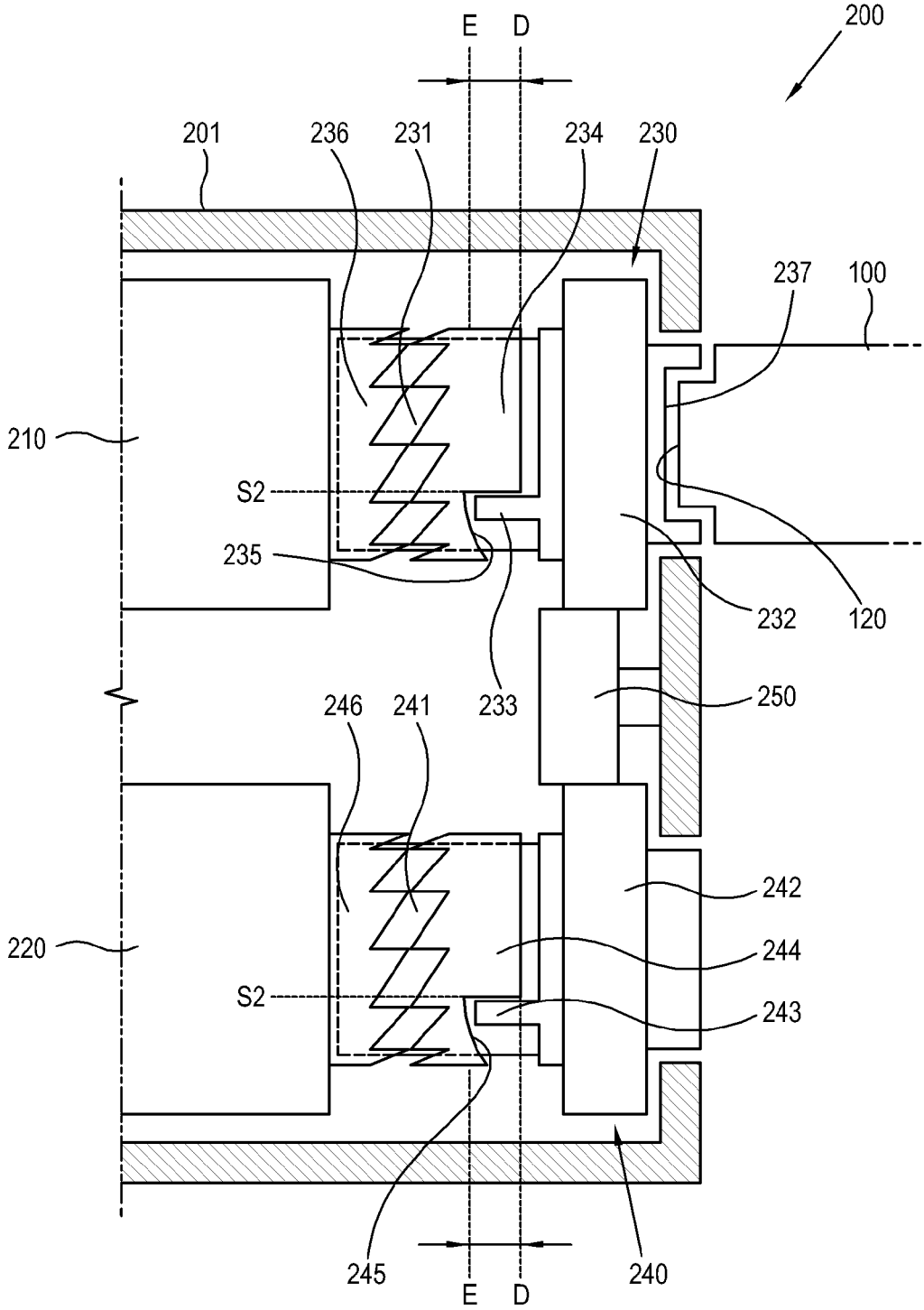
FIG. 7 is a plan view showing how the first and the second clutch unit are disengaged with the first and the second roller main body, respectively, in the second pickup roller assembly shown in FIG. 5.

FIG. 7 is a plan view showing how the first and the second clutch unit 230 and 240 become disengage with the first and the second roller main body 210 and 220, respectively.

As shown in FIG. 7, when the printing-target media M is supplied by being brought into contact with the roller main body 210 in the state where the activating shaft 100 is stopped from being rotated by the activating shaft 100, the first roller main body 210 may also be rotated by the friction with the printing-target media M. At this time, the rotating direction of the first roller main body 210 may be the same as that of the above-described activating shaft 100.

As the first roller main body 210 is rotated, the second engaging part 236 and, furthermore, the first engaging part 234 engaged with the second engaging part 236 may also be rotated. Since, however, the activating shaft 100 is stopped, the first clutch main body 231 may not be rotated. As the first engaging part 234 is rotated, the first protrusion 233 may press the second end S2.

When the first protrusion part 233 presses the second end S2, if the first roller main body 210 is rotated, the first engaging part 234 may be disengaged from the second engaging part 236 and moved back to a disengaged position D. Accordingly, since the first and the second engaging part 234 and 236 are disengaged with each other, the first roller main body 210 may be idle-rotated by being brought into contact with the printing-target media M.

As such, the first and the second clutch unit 230 and 240 may be selectively engaged with the first and the second roller main body 210 and 220, respectively, according to whether or not the activating shaft 100 is rotated.

Figure 8:
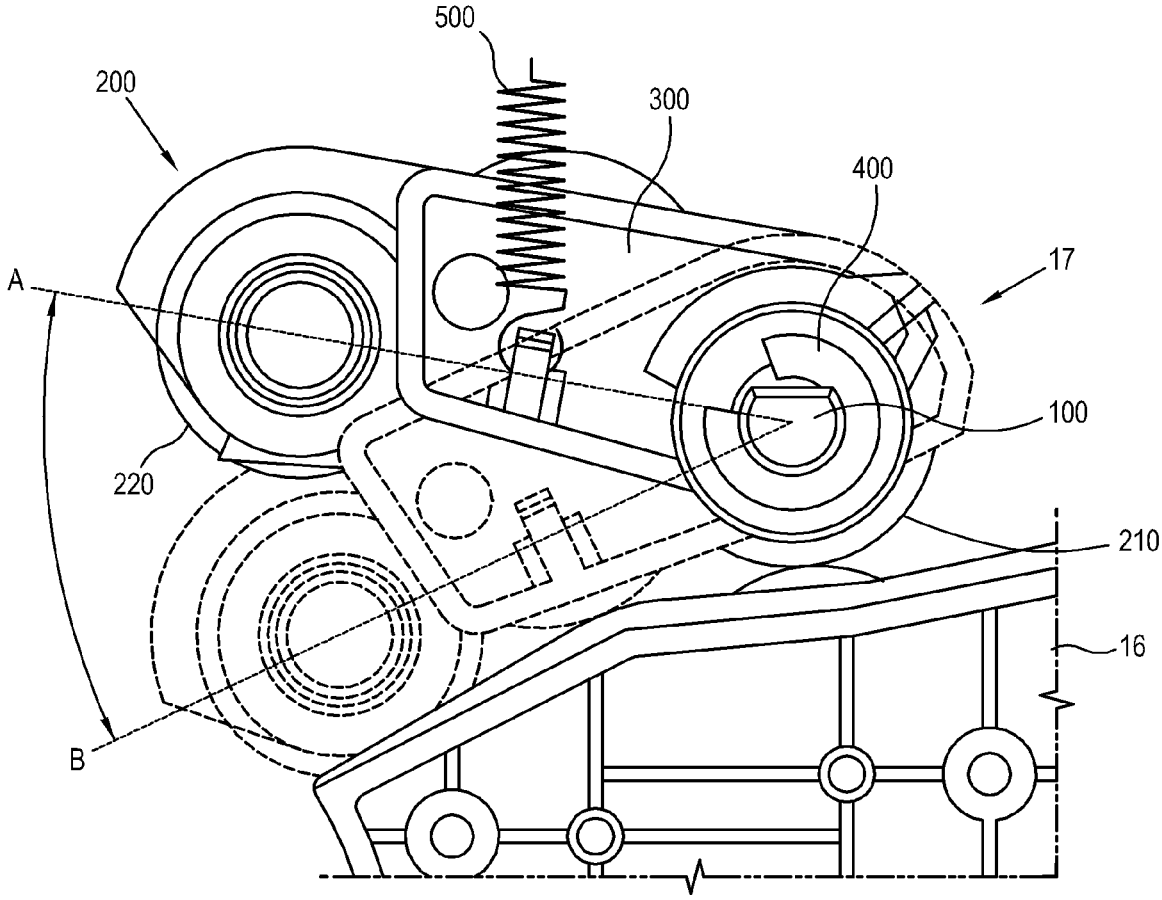
FIG. 8 is a side view showing a pivoting structure of the roller unit in the second pickup roller assembly shown in FIG. 5.

Hereinafter, a pivoting structure of the roller unit 200 according to the rotation of the activating shaft 100 will be described with reference to FIG. 8. FIG. 8 is a side view showing the second pickup roller assembly 17.

As shown in FIG. 8, when the activating shaft 100 and the first roller main body 210 are located at the same axis line, the second roller main body 220 may be pivoted from a supply position B to a separated position A with respect to the first roller main body 210.

The second roller main body 220 may be upwardly pivoted and separated from the printing-target media M in the loading tray 15 to the separated position A such that the printing-target media M are easily loaded in the loading tray 15.

The second roller main body 220 may be downwardly pivoted to the supply position B such that the second roller main body 220 supplies the printing-target media M by being brought into contact therewith. When the activating shaft 100 is stopped from being rotated, the second roller main body 220 may be located at the supply position B.

The first elastic member 400 that has been wound around the activating shaft 100 may be connected to the intermediate member 300, and the second elastic member 500 may elastically bias the intermediate member 300 such that the intermediate member 300 is pivotable to the separated position A.

Hereinafter, a pivoting structure of the second roller main body 220 according to the rotation of the activating shaft 100 will be described.

When the activating shaft 100 is rotated, the diameter of the first elastic member 400 that has been wound around the activating shaft 100 may be reduced. Accordingly, the friction between the first elastic member 400 and the activating shaft 100 may be increased, and the first elastic member 400 may elastically bias the intermediate member 300 in the direction of the supply position B. At this time, the elastic force of the first elastic member 400 may overcome that of the second elastic member 500.

As the intermediate member 300 is pivoted, the second roller main body 200 may also be pivoted to the supply position B. The second roller main body 200 that has been pivoted to the supply position B may be interfered with by the printing-target media M. Such interference may cause the first elastic member 400 to be compressed toward the activating shaft 100.

Such an elastic force of the first elastic member 400 may press the second roller main body 220 toward the printing-target media M, thereby increasing the friction between the second roller main body 220 and the printing-target media M such that the printing-target media M are easily picked up.

On the other hand, when the activating shaft 100 is stopped from being rotated, the wound diameter of the first elastic member 400, reduced when the activating shaft 100 has been rotated, may be recovered to an original state. Accordingly, the friction between the first elastic member 400 and the activating shaft 100 may be decreased, and the second roller main body 220 may be pivoted to the separated position A by the elastic force of the second elastic member 500.

In the above-described configurations of the first and the second elastic member 400 and 500, it is possible to selectively pivot the second roller main body 220 from the supply position B to the separated position A.

In accordance with the exemplary embodiment, it is possible to replace a roller unit only without separating an activating shaft and an intermediate member by installing the intermediate member that is supported by an end portion of the activating shaft and is connected to a first elastic member; and connecting the roller unit to the intermediate member. As such, by simply embodying an assembly structure of the roller unit, a user can easily replace the abraded roller unit and reduce the time that it takes to replace it.

In addition, it is possible to apply a pressing force for picking up printing-target media to the pickup roller by employing a torsion spring that is wound around the activating shaft and reducing such wound diameter thereof.

Moreover, it is possible to scale down the roller unit by employing a plurality of pickup rollers rather than the case of employing one pickup roller.

Further, while the activating shaft is rotated, the first elastic member may cause a second pickup roller to be brought into contact with the printing-target media; on the other hand, when the activating shaft is stopped from being rotated, a second elastic member may cause the second pickup roller to be separated from the printing-target media. Accordingly, the printing-target media may be easily picked up and loaded in a loading tray when such pickup is not performed.

Finally, although the activating shaft is stopped from being rotated, the printing-target media may be easily supplied by employing a first and a second clutch unit where the first and second pickup roller, respectively, are idle-rotated when activating shaft is stopped.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A medium supply unit of an image forming apparatus, the medium supply unit comprising:

a main body housing;

a tray connected to the main body housing and loading a printing-target medium therein;

an activating shaft connected to the main body housing and being rotated in a predetermined direction by an activating force of an activating source;

an intermediate member supported by one end of the activating shaft to deliver a rotating force of the activating shaft;

a first elastic member having one end connected to the intermediate member and another end supported by the activating shaft, and elastically biasing the intermediate member in a direction facing the printing-target medium according to a rotation of the activating shaft; and a roller unit having a roller unit housing that is attachable to the intermediate member and at least one roller that is supported by the roller unit housing and picks up and supplies printing-target media loaded in the tray; and configured to deliver to the roller(s) an elastic force of the first elastic member and a rotating force of the activating shaft when the activating shaft is rotated.

2. The medium supply unit of claim 1, wherein the first elastic member comprises a torsion spring that is wound around the activating shaft, and when the activating shaft is rotated, a wound diameter of the torsion spring is reduced, thereby increasing a friction between the torsion spring and the activating shaft.

3. The medium supply unit of claim 2, wherein the reduced diameter of the torsion spring is recovered to an original state when the activating shaft is stopped to be rotated.

4. The medium supply unit of claim 1, further comprising:

a second elastic member configured to elastically bias the intermediate member in a direction in which the roller unit is separated from the printing-target medium when the activating shaft is stopped to be rotated.

5. The medium supply unit of claim 4, wherein the rollers comprise:

a first roller arranged at a same axis line as that of the activating shaft; and a second roller arranged at an axis line that is separated from and in parallel with the first roller.

6. The medium supply unit of claim 5, wherein the second roller is pivotable, with respect to the first roller, from a supply position, where the printing-target medium loaded in the tray is supplied, to a separated position, where the second roller is separated from the supply position.

7. The medium supply unit of claim 6, wherein the second roller is pivoted to the supply position by the first elastic member when the activating shaft is rotated, and to the separated position by the second elastic member when the activating shaft is stopped from being rotated.

8. The medium supply unit of claim 5, wherein the activating shaft comprises an activating shaft coupling part which is formed at one end thereof extending through a through hole formed in the intermediate member and is coupling-connected with the roller unit to deliver the rotating force of the activating shaft.

9. The medium supply unit of claim 8, wherein the roller unit comprises a first clutch unit which is coupling-connected with the activating shaft coupling part and selectively engaged with the first roller according to whether or not the activating shaft is rotated.

10. The medium supply unit of claim 9, wherein the first clutch unit is engaged with the first roller to deliver the rotating force of the activating shaft, when the activating shaft is rotated, and disengaged therewith to enable the first roller to be idle-rotated, when the activating shaft is stopped from being rotated.

11. The medium supply unit of claim 10, wherein the roller unit further comprises:

a second clutch unit which receives the rotating force of the activating shaft from the first clutch unit and is selectively engaged or disengaged with the second roller to selectively deliver the delivered rotating force according to whether or not the first clutch unit is engaged with the first roller.

12. An image forming apparatus comprising:

a medium supply unit configured to supply a printing-target medium; and an image forming unit configured to form an image on the printing-target medium supplied from the medium supply unit, wherein the medium supply unit comprises:

a main body housing;

a tray connected to the main body housing and loading a printing-target medium therein;

an activating shaft connected to the main body housing and being rotated in a predetermined direction by an activating force of an activating source;

an intermediate member supported by one end of the activating shaft to deliver a rotating force of the activating shaft;

a first elastic member having one end connected to the intermediate member and the other end supported by the activating shaft, and elastically biasing the intermediate member in a direction facing the printing-target medium according to a rotation of the activating shaft; and a roller unit having a roller unit housing that is attachable to the intermediate member and at least one roller that is supported by the roller unit housing and picks up and supplies printing-target media loaded in the tray; and configured to deliver to the roller(s) an elastic force of the first elastic member and a rotating force of the activating shaft when the activating shaft is rotated.

13. A medium supply unit, comprising:

an activating shaft to supply a rotating force;

an intermediate member to receive and transfer the rotating force of the activating shaft when the activating shaft is in contact therewith; and a roller unit in contact with the intermediate member and including at least one roller to engage with and disengage with printing media based on whether the activating shaft is supplying a rotating force, wherein the intermediate member comprises:

an elastic device connected to the activating shaft and the intermediate member such that when the activating shaft is rotated, the elastic device applies a force to the intermediate member to move the intermediate member toward the printing media such that the roller unit is brought into contact with the printing media, and wherein the elastic device comprises:

a first elastic member surrounding the activating shaft and connected thereto at one end and connected to the intermediate member an opposite end such that when the activating member is rotated, the first elastic member receives a force to be compressed closer to the activating member; and a second elastic member connected at one end to the intermediate member to bias the intermediate member away from the printing media, wherein when the activating shaft rotates by a certain predetermined amount, the force to compress the first elastic member becomes greater that an elastic force of the second elastic member to elastically bias the intermediate member toward the printing media, and when the activating shaft is stopped from rotating, the first elastic member becomes uncompressed such that the elastic force of the second elastic member overcomes the elastic force of the first elastic member to elastically bias the intermediate member away from the printing media.

14. The medium supply unit of claim 13, wherein the roller unit comprises:

a clutching device to engage the at least one roller to rotate when the activating shaft is rotated, and to disengage the at least one roller such that the at least one roller is idle when the activating shaft is not rotated.

15. The medium supply unit of claim 14, wherein the at least one roller comprises:

a first roller to engage with the clutching device when the activating shaft is rotated; and a second roller to engage with the clutching device when the activating shaft is rotated.

16. The medium supply unit of claim 14, wherein the clutching device comprises:

a first clutching unit to engage with the first roller;

a second clutching unit to engage with the second roller; and an intermediate gear to engage the first and second clutching units to rotate together when the activating shaft rotates.

17. A medium supply unit, comprising:

an activating shaft to supply a rotating force;

a roller unit in contact with the activating shaft and including at least one roller to engage with and disengage with printing media based on whether the activating shaft is supplying a rotating force; and an elastic support system connected between the activating shaft and the roller unit to supply an elastic force to the roller unit to bias the roller unit toward the printing media when the activating shaft supplies a predetermined amount of rotating force, wherein the roller unit comprises:

a clutching system in contact with an end of the activating shaft to engage the at least one roller to rotate when the activating shaft is rotated such that a frictional force is applied to the printing media when the activating shaft rotates, and to disengage the at least one roller to be idle when the activating shaft is stooped from being rotated.

* * * * *